US009121610B2

(12) United States Patent
Lam

(10) Patent No.: US 9,121,610 B2
(45) Date of Patent: Sep. 1, 2015

(54) COMBUSTOR DYNAMIC ATTENUATION AND COOLING ARRANGEMENT

(75) Inventor: Kam-Kei Lam, Bracebridge Heath (GB)

(73) Assignee: SIEMENS AKTIENGESELLSCHAFT, München (DE)

( * ) Notice: Subject to any disclaimer, the term of this patent is extended or adjusted under 35 U.S.C. 154(b) by 1005 days.

(21) Appl. No.: 12/435,474

(22) Filed: May 5, 2009

(65) Prior Publication Data

US 2009/0277180 A1 Nov. 12, 2009

(30) Foreign Application Priority Data

May 7, 2008 (EP) ..... 08008606

(51) Int. Cl.
*F23R 3/06* (2006.01)
*F23R 3/00* (2006.01)
*F23M 20/00* (2014.01)

(52) U.S. Cl.
CPC ..... *F23R 3/06* (2013.01); *F23M 20/005* (2015.01); *F23R 3/002* (2013.01); *F23R 2900/00014* (2013.01); *F23R 2900/03041* (2013.01); *F23R 2900/03042* (2013.01); *F23R 2900/03043* (2013.01); *F23R 2900/03045* (2013.01)

(58) Field of Classification Search
CPC ..... F23M 20/005; F23R 2900/00013; F23R 2900/00014; F23R 2900/03041; F23R 2900/03042; F23R 2900/03043; F23R 2900/03045; F23R 3/002; F23R 3/06; F23D 2210/00
USPC ..... 60/725, 752, 753, 754, 755, 756, 757, 60/758, 759, 760; 431/114
See application file for complete search history.

(56) References Cited

U.S. PATENT DOCUMENTS

| | | | | | |
|---|---|---|---|---|---|
| 2,395,114 | A | * | 2/1946 | Goddard | 60/201 |
| 2,532,712 | A | * | 12/1950 | Goddard | 60/752 |
| 2,881,337 | A | * | 4/1959 | Wall | 310/57 |
| 3,175,361 | A | * | 3/1965 | Schirmer et al. | 60/746 |
| 3,572,031 | A | * | 3/1971 | Szetela | 60/757 |
| 3,672,162 | A | * | 6/1972 | Rygelis et al. | 60/800 |
| 3,706,203 | A | * | 12/1972 | Goldberg et al. | 60/757 |
| 3,848,697 | A | * | 11/1974 | Jannot et al. | 181/220 |
| 3,850,261 | A | * | 11/1974 | Hehmann et al. | 181/286 |
| 3,916,619 | A | * | 11/1975 | Masai et al. | 60/756 |
| 4,030,875 | A | * | 6/1977 | Grondahl et al. | 60/753 |
| 4,122,674 | A | * | 10/1978 | Andersson et al. | 60/725 |
| 4,135,603 | A | * | 1/1979 | Dean et al. | 181/286 |
| 4,150,732 | A | * | 4/1979 | Hoch et al. | 181/213 |
| 4,199,936 | A | * | 4/1980 | Cowan et al. | 60/226.1 |
| 4,244,441 | A | * | 1/1981 | Tolman | 181/213 |
| 4,314,621 | A | * | 2/1982 | Hansen | 181/233 |
| 4,361,010 | A | * | 11/1982 | Tanrikut et al. | 60/757 |

(Continued)

FOREIGN PATENT DOCUMENTS

| | | | |
|---|---|---|---|
| DE | 102006040760 | A1 | 3/2003 |
| DE | 2006040760 | A1 | 3/2008 |

(Continued)

*Primary Examiner* — Phutthiwat Wongwian
*Assistant Examiner* — Michael B Mantyla

(57) ABSTRACT

Disclosed is a combustor casing with an inner casing which defines a combustion chamber, an outer casing spaced apart from the inner casing for defining a passage between the inner and the outer casing, first and second effusion holes arranged in the inner casing, and dividing ribs connecting the inner and outer casings and forming at least first and second volumes for receiving part of a flow injected into the passage.

18 Claims, 2 Drawing Sheets

(56) References Cited

U.S. PATENT DOCUMENTS

| | | | | |
|---|---|---|---|---|
| 4,392,355 | A * | 7/1983 | Verdouw | 60/752 |
| 4,872,312 | A * | 10/1989 | Iizuka et al. | 60/760 |
| 5,241,827 | A * | 9/1993 | Lampes | 60/754 |
| 5,363,654 | A * | 11/1994 | Lee | 60/752 |
| 5,647,202 | A * | 7/1997 | Althaus | 60/266 |
| 5,782,294 | A | 7/1998 | Froemming et al. | |
| 5,802,841 | A * | 9/1998 | Maeda | 60/784 |
| 6,116,375 | A * | 9/2000 | Lorch et al. | 181/224 |
| 6,550,574 | B2 * | 4/2003 | Liu | 181/286 |
| 6,640,544 | B2 * | 11/2003 | Suenaga et al. | 60/725 |
| 6,669,436 | B2 * | 12/2003 | Liu | 415/1 |
| 6,725,666 | B2 * | 4/2004 | Tiemann | 60/798 |
| 6,761,031 | B2 * | 7/2004 | Bunker | 60/752 |
| 6,925,808 | B2 * | 8/2005 | Tiemann | 60/722 |
| 6,964,170 | B2 * | 11/2005 | Alkabie | 60/772 |
| 6,981,358 | B2 * | 1/2006 | Bellucci et al. | 60/39.17 |
| 7,089,741 | B2 * | 8/2006 | Ikeda et al. | 60/725 |
| 7,104,065 | B2 * | 9/2006 | Benz et al. | 60/725 |
| 7,124,588 | B2 * | 10/2006 | Gerendas et al. | 60/752 |
| 7,568,335 | B2 * | 8/2009 | Althaus | 60/39.17 |
| 7,614,235 | B2 * | 11/2009 | Burd et al. | 60/754 |
| 7,984,787 | B2 * | 7/2011 | Liu et al. | 181/233 |
| 2002/0066273 | A1 * | 6/2002 | Kitamura et al. | 60/737 |
| 2004/0248053 | A1 | 12/2004 | Benz | |
| 2006/0277921 | A1 | 12/2006 | Parker | |
| 2007/0209366 | A1 * | 9/2007 | Gerendas et al. | 60/752 |
| 2007/0256889 | A1 * | 11/2007 | Yu et al. | 181/214 |
| 2008/0190111 | A1 * | 8/2008 | Tiribuzi | 60/725 |
| 2009/0139238 | A1 * | 6/2009 | Martling et al. | 60/740 |

FOREIGN PATENT DOCUMENTS

| | | | |
|---|---|---|---|
| EP | 0896193 | A2 | 2/1999 |
| EP | 1650503 | A1 | 4/2006 |
| EP | 1666795 | A1 | 6/2006 |
| GB | 2104965 | | 3/1983 |

* cited by examiner

COMBUSTOR DYNAMIC ATTENUATION AND COOLING ARRANGEMENT

CROSS REFERENCE TO RELATED APPLICATIONS

This application claims priority of European Patent Application No. 08008606.9 EP filed May 7, 2008, which is incorporated by reference herein in its entirety.

FIELD OF THE INVENTION

The invention relates to a combustor casing with improved acoustic damping and cooling.

BACKGROUND OF THE INVENTION

Protecting our environment is an important responsibility. This is why authorities give limits for pollutant emission like NOx (oxides of nitrogen), CO (carbon monoxide) and UHC (unburned hydrocarbons) for gas turbines.

In lean burn combustors an increased flow of air into the combustor leads to fuel to air ratios below the level where high levels of NOx is formed. The drawback of increased air flow is that it can cause instabilities in the combustion process resulting in highly fluctuating pressure amplitudes at frequencies below 1000 Hz for a typical combustion system which can cause hardware damages to the combustion chamber.

Combustion chambers are usually cooled by a flow of air along the chamber and through perforations also known as effusion holes arranged in the casing of the chamber. Air penetrating through the effusion holes into the combustion chamber forms a cooling film over the inner surface of the combustion chamber, the film reducing convective heat transfer between the combustion flame and the inner casing of the combustion chamber.

It has been proposed to use the air for both film cooling and damping of instabilities in the combustion process. However, the flow of cooling air has usually different characteristics like volume and velocity to a flow providing damping.

EP 1666795 describes an acoustic damper component arranged on the wall of a combustor with multiple damping chambers. The acoustic damper component has a first metering passage, a first damping chamber, a first damping passage, a second damping chamber and a second damping passage. Air flows through the damper to be ejected into the combustion chamber from the second damping passage at a selected velocity and volumetric flow, the flow being sufficient to damp instabilities from the combustion process.

GB2104965 shows a multiple impingement cooled structure which is coupled to effusion holes in the wall of an element to be cooled such as a turbine shroud. The structure includes a plurality of baffles which define a plurality of cavities.

EP0896193 shows a combined impingement and convective cooling configuration of the combustion chamber where substantially all air flow into the combustion chamber passes through the cooling passage before entering the combustion chamber, i.e. that all of the air utilized is used for both cooling and for mixing with the fuel, assuring good cooling of components and producing a lean mixture which acts to keep the levels of pollutants such as nitrous oxides low.

SUMMARY OF THE INVENTION

An object of the invention is to provide a combustor casing with improved damping and cooling characteristics.

This object is achieved by the claims. The dependent claims describe advantageous developments and modifications of the invention.

An inventive combustor casing comprises an inner casing which defines a combustion chamber, an outer casing spaced apart from the inner casing for defining a passage between the inner and the outer casing, effusion holes arranged in the inner casing, and dividing ribs connecting the inner and outer casings and forming at least first and second volumes for receiving part of a flow injected into the passage.

The invention exploits the phenomenon of air resonance in a cavity. Air forced into a cavity will make the pressure inside the cavity increase. When the external force that forces the air into the cavity disappears, the air with higher-pressure inside the cavity will flow out. Since this surge of air flowing out of the cavity will tend to over-compensate due to the inertia of the air, the cavity will be left at a pressure slightly lower than outside. Air will then be drawn back in again. Each time this process repeats the magnitude of the pressure changes decreases, meaning that the air trapped in the chamber acts like a spring, wherein the spring constant is defined by the dimension of the chamber.

Preferably the at least first and second volumes defined by the dividing ribs differ in size allowing for multiple frequencies attenuation.

It is advantageous when the first volume has first effusion holes with a first effusion hole diameter and the second volume has second effusion holes with a second effusion hole diameter and the first and second effusion hole diameters are different since this allows to optimize the damping performance.

Furthermore, it is advantageous when a first spacing between the first effusion holes differs from a second spacing between the second effusion holes since this further improves the damping performance.

In one advantageous embodiment the effusion holes and the at least first and second volumes are arranged in areas of previously determined antinodes of dynamic acoustic waves to be damped during operation of the combustion chamber. This allows the maximum of the acoustic energy to enter and dissipate in the attenuation volume.

In a preferred arrangement and in order to give maximum cooling, turbulators are arranged in the cooling passage providing turbulence of the air flowing down the cooling passage. The turbulators are preferably arranged on the inner casing and extend around the combustor, i.e. in a direction traverse to a flow direction. The turbulators are applied on the cooling surface to energise the thermal boundary layer for enhancing convective heat transfer coefficient.

In one advantageous embodiment the ribs extend along the passage parallel to a centre line of the combustor casing. This is the most common solution and the easiest to manufacture.

In another advantageous embodiment the ribs extend along the passage following at least partially a helical curve, thus creating near ring shaped resonators.

The invention is not restricted to can-type combustors. It is also applicable to annular combustors or sequential/reheat burners which require cooling due to the high burner inlet temperatures generated by the combustion in the upstream first stage combustion chamber.

BRIEF DESCRIPTION OF THE DRAWINGS

The invention will now be further described with reference to the accompanying drawings in which.

Figure 1:
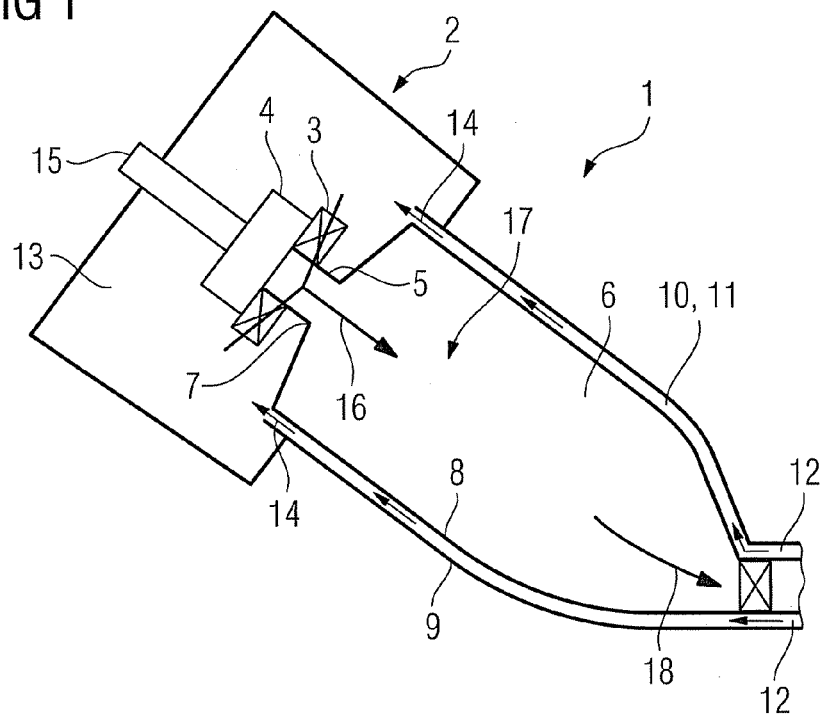
FIG. 1 represents a general combustor cooling scheme.

In the drawings like references identify like or equivalent parts.

DETAILED DESCRIPTION OF THE INVENTION

A gas turbine engine comprises a compressor section, a combustor section and a turbine section which are arranged adjacent to each other. In operation of the gas turbine engine air is compressed by the compressor section and output to the burner section with one or more combustors. FIG. 1 shows a general combustor scheme. The combustor 1 comprises a burner 2 with a swirler portion 3 and a burner head portion 4 attached to the swirler portion 3, a transition piece being referred to as a combustion pre-chamber 5 and a main combustion chamber 6 arranged in flow series. The main combustion chamber 6 has a larger diameter than the diameter of the pre-chamber 5. The main combustion chamber 6 is connected to the pre-chamber 5 at the upstream end 7. The burner 2 and the combustion chamber assembly show rotational symmetry about a longitudinal symmetry axis.

Moreover, the main combustion chamber 6 and the pre-chamber 5 comprise an inner casing 8 and an outer casing 9.

There is an internal space 10 between the inner casing 8 and the outer casing 9 which is used as cooling passage 11 for cooling the inner casing 8. Air enters the cooling passage 11 through the cooling air entrance 12 and convectively cools the combustor wall, particularly the inner casing 8 by arrangements of turbulators and effusion holes arranged in the inner casing 8 to allow the cooling air to penetrate into the main combustion chamber 6 and to form a cooling film that provides an insulating layer and protects the inner casing 8 by limiting the convective heat transfer. To obtain a uniform film over the length of the combustor facing surface a number of axially spaced parallel rows of effusion holes is provided.

Part of the air exits the cooling passage 11 and enters the burner hood 13 (see arrows 14). A fuel duct 15 is provided for leading a gaseous or liquid fuel to the burner 2 which is to be mixed with in-streaming air in the swirler 3. The fuel-air-mixture 16 is then led towards the primary combustion zone 17 where it is burnt to form hot, pressurised exhaust gas flowing in a direction indicated by arrow 18 to a turbine of the gas turbine engine (not shown).

Figure 2:
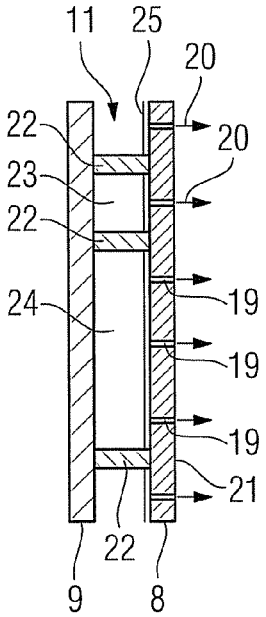
FIG. 2 represents a side view on a combustion dynamic attenuation and cooling scheme.

FIG. 2 shows the cooling passage 11 looking into the flow direction with the outer casing 9 of the combustor 1 on the left and the inner casing 8 of the combustor 1 on the right side of FIG. 2. Effusion holes 19 are arranged in the inner casing 8. The flow of air 20 through the effusion holes 19 provides film cooling of the inner side 21 of the inner casing 8 and damping. When a sound wave passes an effusion hole 19 a vortex ring is generated and some of the energy of the sound wave is dissipated into vortical energy that is subsequently transformed into heat energy.

Dividing ribs 22 extend along the cooling passage 11 connecting the inner 8 and outer casings 9 and dividing the volume within the cooling passage 11 into the required dynamic attenuation volumes shown as at least first and second volumes 23, 24. Since different dynamic frequencies need different damping volumes, multiple frequencies can be attenuated by dividing the cooling passage space into different patches for the intended attenuation frequencies. Cooling air passes through theses volumes of the cooling passage 11 and partly enters the combustion chamber 6 through the effusion holes 19. The at least first and second volumes 23, 24 and the effusion holes 19 arranged in the at least first and second volumes 23, 24 act as Helmholtz resonators. FIG. 2 also shows turbulators 25 arranged in the cooling passage 11 on the inner casing 8.

Figure 3:
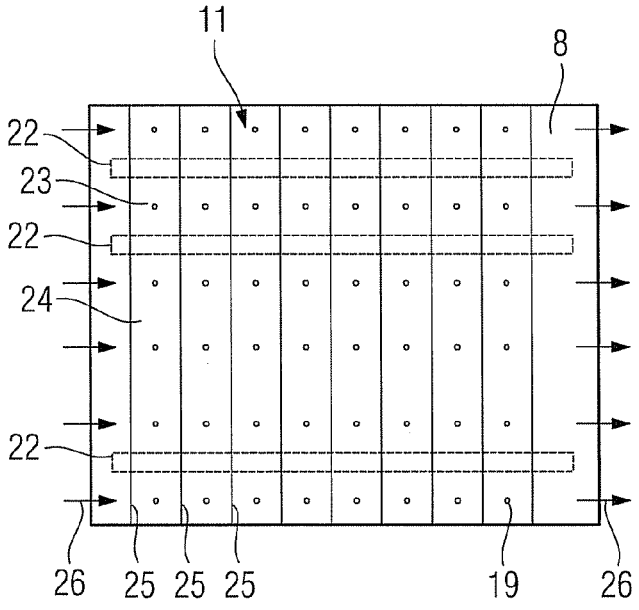
FIG. 3 represents the same scheme as shown in FIG. 2 seen from a different angle.

With reference to FIG. 3 a topview of the inner casing 8 with dividing ribs 22 and effusion holes 19 is shown. Again, the dividing ribs 22 are not equally spaced to form at least first and second volumes 23, 24 in the cooling passage 11. The turbulators 25 arranged in the cooling passage 11 on the inner casing 8 are extending in a direction traverse to a flow direction of cooling air 26.

Figure 4:
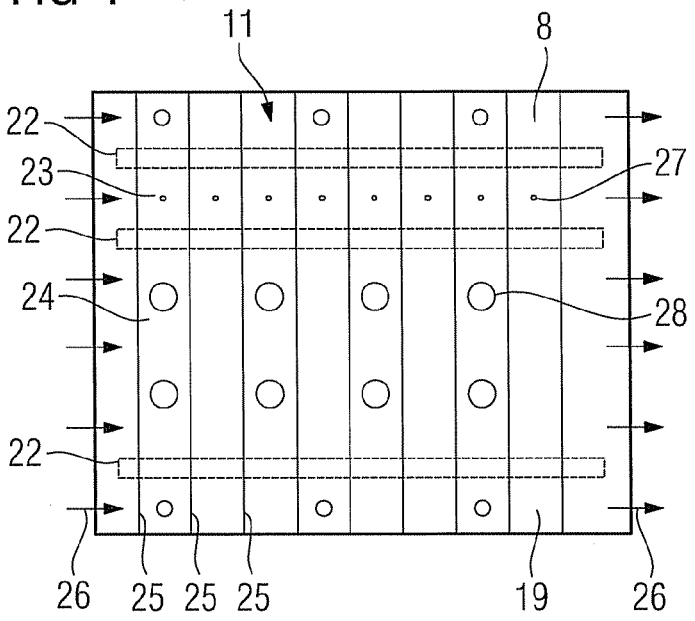
FIG. 4 shows the hole pattern of the effusion holes.

FIG. 4 is a view onto the inner casing 8 of the combustor 1 and shows the at least first and second volumes 23, 24 defined by the ribs 22 and different effusion hole patterns with first and second effusion holes 27, 28 in the respective volumes. The patterns can differ in different ways. The effusion hole diameters can be different and the effusion hole spacing can be different. Both parameters can be adapted to specific frequencies to optimize damping performance and can of course differ between different volumes. The flow direction of the main air flow is shown by the arrows 26.

Figure 5:
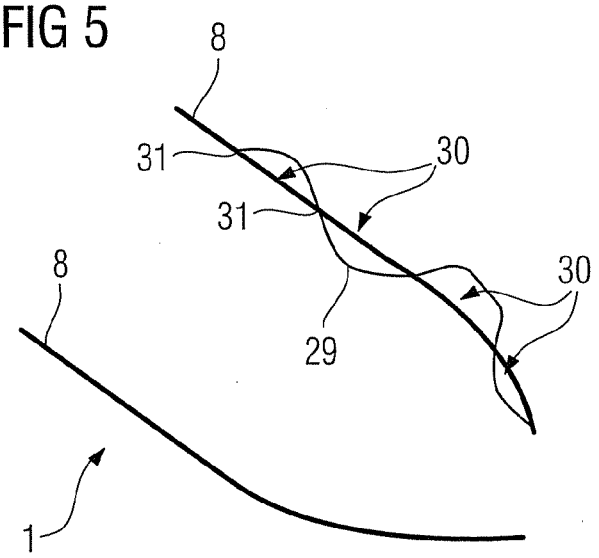
FIG. 5 shows an axial mode dynamic pressure wave on a combustor casing and the best locations for the attenuation and cooling arrangement.
Figure 6:
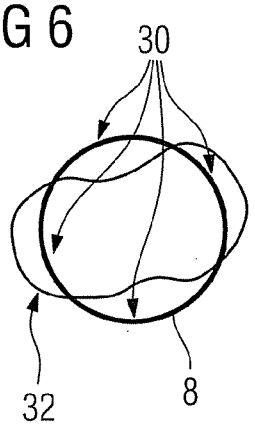
FIG. 6 shows a circumference mode on a combustor.

FIG. 5 shows a sectional view of a combustor 1. An example of an axial mode dynamic pressure wave 29 on the combustor casing is indicated with antinodes 30 and nodal points 31. Similarly FIG. 6 shows an example of a circumference mode 32 of a combustor 1. The best locations to place the attenuation effusion hole patterns are the anti-nodes 30 of the corresponding dynamic acoustic wave 29, 32.

Even though the figures focus on can-type combustors the invention is not restricted thereupon. It is also applicable to annular combustors or sequential/reheat burners.

What is claimed is:

1. A combustor casing, comprising:

an inner casing defining a combustion chamber;

an outer casing spaced apart from the inner casing for defining a passage between the inner and the outer casing, the passage being adapted to guide cooling air from a cooling air entrance arranged at a downstream end of the combustion chamber to a burner hood arranged at an upstream end of the combustion chamber;

first and second effusion holes arranged in the inner casing, through which a portion of the cooling air penetrates into the combustion chamber; and dividing ribs connecting the inner casing and outer casing and forming first and second volumes for receiving part of a flow injected into the passage, wherein the dividing ribs are separate from one another and are not equally spaced to form the first and second volumes, wherein the first effusion holes are arranged in the first volume and the second effusion holes are arranged in the second volume, and wherein the first effusion holes have a first pattern and the second effusion holes have a second pattern, such that the first and second patterns differ in terms of hole diameters and/or spacing between the holes, and wherein the first and second volumes, as well as the hole diameters and/or spacing between the holes are adapted to specific frequencies to optimise damping performance and differ between different volumes.

2. The combustor casing as claimed in claim 1, wherein the first and second effusion holes and the first and second volumes are arranged in areas of previously determined antinodes of dynamic acoustic waves to be damped during operation of the combustion chamber.

3. The combustor casing as claimed in claim 1, wherein turbulators are arranged in the passage.

4. The combustor casing as claimed in claim 3, wherein the turbulators are arranged on the inner casing.

5. The combustor casing as claimed in claim 3, wherein the turbulators extend in a direction traverse to a flow direction.

6. The combustor casing as claimed in claim 1, wherein the dividing ribs extend along the passage parallel to a centre line of the combustor casing.

7. The combustor casing as claimed in claim 1, wherein there are more second effusion holes in the second pattern than first effusion holes in the first pattern.

8. The combustor casing as claimed in claim 1, wherein there are more rows of second effusion holes in the second pattern than rows of first effusion holes in the first pattern.

9. The combustor casing as claimed in claim 1, wherein the second effusion holes in the second pattern have a greater diameter than the diameter of the first effusion holes in the first pattern.

10. The combustor casing as claimed in claim 1, wherein the second effusion holes in the second pattern have a greater spacing than the spacing of the first effusion holes in the first pattern.

11. The combustor casing as claimed in claim 1, wherein the dividing ribs are not equally spaced in a direction transverse to the cooling air flow direction from the cooling air entrance to the burner hood.

12. The combustor casing as claimed in claim 1, wherein the second volume has a greater volume than the first volume.

13. A combustor, comprising:

a combustor casing, the combustor casing having an inner casing defining a combustion chamber;

an outer casing spaced apart from the inner casing for defining a passage between the inner and the outer casing, the passage being adapted to guide cooling air from a cooling air entrance arranged at a downstream end of the combustion chamber to a burner hood arranged at an upstream end of the combustion chamber;

first and second effusion holes arranged in the inner casing, through which a portion of the cooling air penetrates into the combustion chamber; and dividing ribs connecting the inner casing and outer casing and forming first and second volumes for receiving part of a flow injected into the passage, wherein the dividing ribs are separate from one another and are unequally spaced to form the first and second volumes, wherein the first effusion holes are arranged in the first volume and the second effusion holes are arranged in the second volume, wherein the first effusion holes have a first pattern and the second effusion holes have a second pattern, such that the first and second patterns differ in terms of hole diameters and/or spacing between the holes, and wherein the first and second volumes, as well as the hole diameters and/or spacing between the holes are adapted to specific frequencies to optimise damping performance and differ between different volumes.

14. The combustor as claimed in claim 13, wherein the combustor is a can-type combustor.

15. The combustor as claimed in claim 13, wherein the combustor is an annular combustor.

16. The combustor as claimed in claim 13, wherein the combustor is a sequential combustor.

17. The combustor as claimed in claim 13, wherein the combustor is a reheat combustor.

18. The combustor as claimed in claim 13, wherein the first and second effusion holes and the first and second volumes are arranged in areas of previously determined antinodes of dynamic acoustic waves to be damped during operation of the combustion chamber.

* * * * *